US006576187B2

(12) United States Patent
Ribault et al.

(10) Patent No.: US 6,576,187 B2
(45) Date of Patent: Jun. 10, 2003

(54) 18 CARAT GREY GOLD ALLOY, WITHOUT NICKEL AND WITHOUT PALLADIUM, FOR JEWELLERY

(75) Inventors: Laurent Ribault, Neuilly Plaisance (FR); Annie LeMarchand, Blanc Mesnil (FR)

(73) Assignee: Cookson Metaux Precieux SA, Paris (FR)

( * ) Notice: Subject to any disclaimer, the term of this patent is extended or adjusted under 35 U.S.C. 154(b) by 0 days.

(21) Appl. No.: 09/968,624

(22) Filed: Oct. 2, 2001

(65) Prior Publication Data

US 2002/0168284 A1 Nov. 14, 2002

(30) Foreign Application Priority Data

Oct. 6, 2000 (FR) ..... 00 12781

(51) Int. Cl.[7] ..... C22C 5/02
(52) U.S. Cl. ..... 420/511; 148/430
(58) Field of Search ..... 420/511; 148/430

(56) References Cited

U.S. PATENT DOCUMENTS 5,636,421 A * 6/1997 Brams ..... 63/28
6,342,182 B1 * 1/2002 Vincent ..... 420/508

FOREIGN PATENT DOCUMENTS

| | | | | |
|---|---|---|---|---|
| CH | 684616 | | 11/1994 | |
| CH | 686136 | A5 * | 1/1996 | ..... C22C/5/02 |
| DE | 43 20 928 | | 3/1994 | |
| DE | 94 12 585.6 | | 10/1994 | |
| DE | 44 23 646 | | 8/1995 | |
| EP | 1227166 | A1 * | 7/2002 | ..... C22C/5/02 |
| EP | 1245688 | A2 * | 10/2002 | ..... C22C/5/02 |
| FR | 2764906 | | 12/1998 | |
| GB | 637421 | * | 5/1950 | |
| JP | 63 024051 | | 2/1988 | |
| JP | 04-362148 | A * | 12/1992 | ..... C22C/5/02 |
| JP | 2001-335860 | A * | 12/2001 | ..... C22C/5/02 |

OTHER PUBLICATIONS

Translation of JP–63–024051, by Yoshida et al published Feb. 1988.*
Abstract of JP 2001–335861–A by Sakurai et al, Dec. 4, 2001.*
Derwent Acc No. 1999–073370 for FR 2764906 A1, by Pozarnik et al and published Dec. 24, 1998, abstract.*

* cited by examiner

*Primary Examiner*—Roy King
*Assistant Examiner*—Harry D. Wilkins, III
(74) *Attorney, Agent, or Firm*—Dennison, Schultz & Dougherty

(57) ABSTRACT

The invention relates to a novel grey gold alloy essentially without whitening element such as nickel, palladium and cobalt, characterized in that it contains in addition to the gold, copper, silver and manganese, according to the following proportions in percentages by weight, of:

| | |
|---|---|
| gold | 75–78 |
| silver | 1–10 |
| manganese | 7–15; and |
| remainder of copper to | 100. |

This alloy is particularly advantageous for manufacturing jewels, notably by the disposable wax casting technique.

30 Claims, No Drawings

18 CARAT GREY GOLD ALLOY, WITHOUT NICKEL AND WITHOUT PALLADIUM, FOR JEWELLERY

The present invention essentially relates to an 18 carat grey gold alloy for jewellery. More specifically, the present invention essentially relates to a novel 18 carat grey gold alloy for jewellery which is without currently known whitening agents which are mainly nickel, palladium and cobalt, characterised in that it consists essentially, in addition to the gold, copper, silver and manganese, according to the following proportions in percentages by weight, of:

| | |
|---|---|
| gold | 75–78 |
| silver | 1–10 |
| manganese | 7–15 |
| remainder of copper to | 100. |

This alloy is particularly advantageous for manufacturing jewels, notably by the disposable wax casting technique.

Thus, according to a preferred characteristic of the invention, this novel grey gold alloy is without nickel, without palladium and without cobalt. The alloy according to the invention has the advantage of removing the risk of occurrence of allergy caused by the nickel contained in most grey gold alloys of ordinary quality and of being less costly than the grey gold alloys which contain palladium.

TECHNICAL BACKGROUND

The fashion of grey gold alloys appeared in the years 1910–1920, at the same time as the platinum alloys. Platinum was very expensive and its availability was greatly reduced by its use as a strategic metal for industry. Moreover, the legal titre of platinum alloys is 95% whilst that of gold is 75%, by weight.

It was thus sought to obtain a gold-based precious alloy, but the colour of which would approach that of platinum as much as possible.

The difficulty with 18 carat gold alloys which contain about 75% by weight of gold is that the sole 25% remaining of elements to be added must remove the yellow tint of the gold. Amongst all the elements tested, only two have proved to be extremely efficient, nickel and palladium. Their whitening effect enables them to whiten the alloy without adding other white element. The document CH-A-684 616 can be cited for example, which describes an alloy of this type. In this document, grey gold alloys are described which contain 5.5 to 18% of palladium and 2 to 12% of manganese. The grey gold alloys which contain palladium are more costly due to the high price of this element and have low hardness which renders them sensitive to wear. Furthermore, these alloys do not give satisfaction in the context of the disposable wax casting process which is widely used in jewellery, as results from the article by Ralph H. Atkinson in the *Revue Françise des Bijoutiers-Horlogers*, No. 220. February 1959, p. 40–44.

Furthermore, the gold alloys which contain nickel are very difficult to work since they are sensitive to fissuring. Then, the very widespread use of nickel in alloys constituting ornamental pieces which are even worn on the skin has led to an allergic sensitisation to this element. At present, about 10% of women and 2% of men have a reaction to nickel. This state of fact will lead to a progressive interdiction of nickel in objects which are intended to be in continued contact with the skin. The phenomenon of allergy is described for example in the document CH-A-684 616, notably on page 3, lines 21 to 25. The alloys of gold and nickel are known to be hard and their working difficult.

The document CH-A-684 616 is again a good example of a gold alloy which contains palladium in the place of nickel, with manganese, the manganese alone not having a sufficient whitening effect. It is necessary to add another whitening element to it, which is silver in general. If another whitening element such as cobalt is added, the alloy thus becomes slightly magnetic. Before refining, the factory waste go through a first sort with a magnet which must remove all the ferrous particles originating from the wear of the tools. If the alloy is magnetic, the filings of gold alloy will go out of the cycle with the ferrous waste.

The document FR-B-2 764 906 ENGELHARD-CLAL describes a solution of a 18 and 14 carat grey gold alloy for jewellery, without nickel, without palladium and without silver, based on gold, copper and manganese. The melting interval of the alloys described is 920–940° C. in having a colour which is difficult to distinguish from that obtained with a grey gold alloy containing palladium.

Despite the fact that the alloys in accordance with this prior art document, by the same applicant, give satisfaction, the present invention aims, in addition to the objectives indicated hereinafter, to provide novel classes of alloy which have the same qualities but additionally having a castability and an appearance of a cast alloy further improved with respect to alloys without silver, notably from the document FR-B-2,764,906. Furthermore, it is even desirable to provide novel alloys which have at least a melting interval in a temperature range lower than those of the prior alloys of the document FR-B-2,764,906, namely in a temperature interval at the most equal to about 920° C.

OBJECT OF THE INVENTION

Thus, the aim of the present invention is to provide a novel gold alloy which is grey in colour, of 18 carats, and which is essentially without classical whitening element such as nickel, palladium and cobalt.

Another main aim of the present invention is to provide a novel grey gold alloy, in particular of 18 carats, which is without classical whitening element such as nickel, palladium, cobalt, and which has a very good castability as well as an increased hardness leading to a good resistance to abrasion.

Another aim of the invention is to solve the novel technical problems set forth above by providing a solution of a grey gold alloy which eliminates any cause of cutaneous reaction upon continued contact with the skin, and which thus enables its use in jewellery.

Still another aim of the present invention is to solve the novel technical problems set forth above by providing a solution of a grey gold alloy which be capable of being used within the context of the disposable wax casting process, an ancestral process which is advantageously used for manufacturing jewels, an alloy is only useful in this technique when its castability is satisfactory.

DETAILED DESCRIPTION OF THE INVENTION

Within the context of the invention, it has been discovered in a totally unexpected way for the person skilled in the art that the whole of these technical problems set forth was solved by providing a grey gold alloy essentially without classical whitening element such as nickel, palladium and cobalt, characterised in that it consists essentially, in addi tion to the gold, silver, copper and manganese, according to the following proportions in percentages by weight, of:

| | |
|---|---|
| gold | 75–78 |
| silver | 1–10 |
| manganese | 7–15 |
| remainder of copper to | 100. |

According to a preferred embodiment, the amount of manganese for an 18 carat gold alloy is between 7–15, better between 7 and 12% by weight.

According to an advantageous embodiment, the alloy according to the invention can contain 0 to 1%, preferably 0.01 to 1%, by weight of iridium (Ir) and/or of ruthenium (Ru) the presence of which enables the metallurgical structure to be refined.

According to an advantageous mode, the alloy according to the invention can contain 0 to 1%, preferably 0.01 to 1% by weight of silicon (Si) the presence of which enables deoxidising, and increasing the castability.

According to an even more preferred embodiment, a grey gold alloy according to the present invention is selected from the group consisting, in percentages by weight, of:

a) Au75-Ag1-Cu12-Mn12;

b) Au75-Ag3-Cu12-Mn10;

c) Au75-Ag10-Cu8-Mn7;

d) Au75-Ag3-Cu11.9-Mn10-Ir0.1;

e) Au75-Ag3-Cu11.9-Mn10-Ru0.1; and f) Au75-Ag3-Cu11.5-Mn10-Si0.5.

The grey gold alloy actually further preferred of the present invention is an 18 carat grey gold alloy constituted of Au75-Ag3-Cu12-Mn10. This preferred alloy has a melting interval considered as being the best, namely of between about 900 and 920° C.

According to a second aspect, the present invention also relates to the use of this novel alloy for manufacturing jewels, in particular by the disposable wax casting technique, by virtue of their compatibility, estimated to be perfect with the skin, over a continued contact with the skin since this alloy does not seem to give rise to or to create any detectable cutaneous allergy.

According to a third aspect, the present invention also relates to a process of manufacturing these alloys according to which pure gold granules are mixed with a mother alloy of copper and manganese and the amount of copper necessary to attain the final composition as well as the amount of silver are added. Advantageously, the mother alloy of copper and manganese comprises roughly equivalent amounts of copper and of manganese, i.e. that it is of about 50% of copper and about 50% of manganese, by weight. Obviously, in the case of the presence of iridium and/or of ruthenium and/or of silicon, the corresponding amounts of these elements are added before finalising the remainder of copper.

Within the context of this process, the melting is advantageously carried out in a crucible, preferably a zirconia crucible, and the ingot is poured into an ingot mould which is preferably of copper doped with chromium.

According to an advantageous embodiment of the process according to the invention, the melting will preferably be carried out under a protective atmosphere due to the reactivity of the manganese with the oxygen of the air.

The invention will also be better understood with reference to the implementation examples given hereinafter, which are given simply as an illustration and which in no way limit the scope of the invention. In the Examples, all percentages are given by weight, unless indicated otherwise. Furthermore, the temperature is ambient temperature or is expressed in degrees Celsius and the pressure is atmospheric pressure, unless indicated otherwise.

Furthermore, all the Examples make up an integrating part of the invention, as will as every characteristic of the present description, including the Examples, which appears novel over any prior art, and this means in a general characteristic form and not a particular characteristic form of the Example.

EXAMPLES ACCORDING TO THE INVENTION

The various alloys subject of Examples 1 to 6 below are prepared by implementing the process of manufacture according to the invention described above, namely the melting of the alloys is carried out by mixing pure gold granules with a mother alloy which here has about 50% of copper and about 50% of manganese, and by adding the amount of copper necessary to attain the final composition desired as well as the amount of silver necessary. Optionally, in the case of the presence of iridium and/or of ruthenium and/or of silicon, the corresponding amounts of these elements are added before finalising the remainder of copper.

The melting is carried out in a zirconia crucible and the ingot is poured into an ingot mould made from copper doped with chromium. The melting takes place under a protective atmosphere due to the reactivity of the manganese with the oxygen of the air.

According to this process, the manufacture of alloys 1 to 6 is carried out, set forth in Examples 1 to 6 below.

Example 1

An 18 carat alloy is manufactured which has the following composition:

Au75-Ag1-Cu12-Mn12.

Example 2

An 18 carat alloy is manufactured which has the following composition:

Au75-Ag3-Cu12-Mn10.

Example 3

An 18 carat alloy is manufactured which has the following composition:

Au75-Ag10-Cu8-Mn7.

Example 4

An 18 carat alloy is manufactured which has the following composition:

Au75-Ag3-Cu11.9-Mn10-Ir0.1.

Example 5

An 18 carat alloy is manufactured which has the following composition

Au75-Ag3-Cu11.9-Mn10-Ru0.1.

Example 6

An 18 carat alloy is manufactured which has the following composition

Au75-Cu11.5-Mn10-Si0.5.

As was stated above, the preferred alloy is alloy 2 of Example 2 having the composition Au75-Ag3-Cu12-Mn10. The colour of this preferred alloy is measured in accordance with the CIELAB system, with the aid of a Minolta spectrocolorimeter, and the results obtained are the following $L^*=81.8$, $a^*=2.48$, $b^*=8.39$.

By comparison, the grey gold alloy containing palladium commonly marketed, having the following composition :

Au75-Pd12.5-Cu9.5-Ag3, has the following colour values according the same spectrocolorimeter:

L*81.83, a*=2.48, b*=7.44.

The colours of these two alloys can be difficult to distinguish with the naked eye. Furthermore, the melting interval of alloy 2 of Example 2 according to the invention is of 900–920° C. which is the most appropriate melting interval for a melting according to the disposable wax process.

The mechanical characteristics of alloy 2 according to the invention are the following:

Rm=resistance to rupture,

Re=elastic limit,

A=elongation,

Hv=hardness.

In the crude cast state

| Alloy | Hardness Hv5 | Rm (MPa) | Re (MPa) | A % |
|---|---|---|---|---|
| Example 2 | 145 | 330 | 257 | 34 |

Naturally, the invention comprises all means constituting technical equivalents of the means described, as well as the various combinations thereof.

What is claimed is:

1. A grey gold alloy essentially without whitening element, and consisting essentially of gold, silver, manganese and copper, in amounts of, in percent by weight:

| | |
|---|---|
| gold | 75–78 ; |
| silver | 1–10; |
| manganese | 7–15; and |
| remainder of copper to | 100. |

2. The alloy of claim 1, comprising more than 0 and up to 1% by weight of at least one of iridium and of ruthenium.

3. The alloy of claim 1, comprising 0.01 to 1% by weight of at least one of iridium and of ruthenium.

4. The alloy of claim 1, comprising more than 0 and up to 1% by weight of silicon.

5. The alloy of claim 1, comprising 0.01 to 1% by weight of silicon.

6. An article of jewelry, comprising an alloy as defined in claim 1 shaped to form at least a part of the jewelry.

7. The article of claim 6, wherein said alloy is shaped by disposable wax casting.

8. An alloy as defined in claim 1, obtained by admixing pure gold granules with a mother alloy of copper and manganese, and adding the amount of copper and of silver necessary to attain a desired composition, the copper thereby constituting the remainder of the alloy.

9. The alloy of claim 8, wherein the mother alloy of copper and manganese comprises roughly equivalent weight amounts of copper and of manganese.

10. The alloy of claim 8, wherein the mother alloy of copper and manganese comprises about 50% of copper and about 50% of manganese, by weight; and optionally, where the alloy contains at least one element selected from the group consisting of iridium, ruthenium and silicon, said at least one element is added before a final addition of copper.

11. The alloy of claim 8, obtained by admixing the pure gold granules with the mother alloy of copper and manganese, adding the amount of copper and of silver necessary to attain the desired composition, performing a melting thereof in a crucible, obtaining an ingot and the pouring ingot into an ingot mold.

12. The alloy of claim 11, wherein said crucible is a zirconia crucible.

13. The alloy of claim 11, wherein said ingot mold is made of copper doped with chromium.

14. The alloy of claim 8, wherein the melting takes place under a protective atmosphere due to the reactivity of the manganese with the oxygen of the air.

15. A grey gold alloy essentially without whitening element consisting essentially of nickel, palladium and cobalt, said alloy consisting essentially of gold, silver, manganese and copper, in amounts of, in percent by weight:

| | |
|---|---|
| gold | 75–78 ; |
| silver | 1–10; |
| manganese | 7–15; and |
| remainder of copper to | 100. |

16. The grey gold alloy of claim 15, wherein the alloy is an 18 carat gold alloy containing about 75% by weight gold.

17. The grey gold alloy of claim 15, wherein the alloy is an 18 carat gold alloy containing about 75% by weight gold and an amount of manganese between 7 and 12%, by weight.

18. The alloy of claim 15, comprising more than 0 and up to 1% by weight of at least one of iridium and of ruthenium.

19. The alloy of claim 15, comprising 0.01 to 1% by weight of at least one of iridium and of ruthenium.

20. The alloy of claim 15, comprising more than 0 and up to 1% by weight of silicon.

21. The alloy of claim 15, comprising 0.01 to 1% by weight of silicon.

22. An article of jewelry, comprising an alloy as defined in claim 15 shaped to form at least a part of the jewelry.

23. The article of claim 22, wherein said alloy is shaped by disposable wax casting.

24. An alloy as defined in claim 15, obtained by admixing pure gold granules with a mother alloy of copper and manganese, and adding the amount of copper and of silver necessary to attain a desired composition, the copper thereby constituting the remainder of the alloy.

25. A grey gold alloy selected from the group consisting of, in percent by weight:

Au75-Ag10-Mn7-Cu8;

Au75-Ag3-Mn10-Cu12;

Au75-Ag1-Mn12-Cu12;

Au75-Ag3-Mn10-Cu11.9-Ir0.1;

Au75-Ag3-Mn10-Cu11.9-Ru0.1; and

Au75-Ag3-Mn10-Cu11.5-Si0.5.

26. An article of jewelry, comprising an alloy as defined in claim 25 shaped to form at least a part of the jewelry.

27. The article of claim 26, wherein said alloy is shaped by disposable wax casting.

28. An 18 carat grey gold alloy consisting essentially of Au75-Ag3-Mn10-Cu12.

29. The 18 carat grey gold alloy of claim 28, having a melting range of between about 900 and 920° C.

30. An article of jewelry, comprising an alloy as defined in claim 28 shaped to form at least a part of the jewelry.

* * * * *